US008857650B2

(12) United States Patent
Skovholt

(10) Patent No.: US 8,857,650 B2
(45) Date of Patent: Oct. 14, 2014

(54) CRYOGENIC LIQUID STORAGE TANK

(75) Inventor: Otto Skovholt, Trondheim (NO)

(73) Assignee: Iglo Contractors AS, Trondheim (NO)

( * ) Notice: Subject to any disclaimer, the term of this patent is extended or adjusted under 35 U.S.C. 154(b) by 406 days.

(21) Appl. No.: 13/144,607

(22) PCT Filed: Jan. 15, 2010

(86) PCT No.: PCT/NO2010/000016

§ 371 (c)(1),
(2), (4) Date: Sep. 7, 2011

(87) PCT Pub. No.: WO2010/082833

PCT Pub. Date: Jul. 22, 2010

(65) Prior Publication Data

US 2011/0315691 A1 Dec. 29, 2011

(30) Foreign Application Priority Data

Jan. 15, 2009 (GB) ..... 0900646.1

(51) Int. Cl.
*F17C 13/00* (2006.01)
*F17C 3/02* (2006.01)

(52) U.S. Cl.
CPC ..... *F17C 3/022* (2013.01); *F17C 2203/0604* (2013.01); *F17C 2209/21* (2013.01);

(Continued)

(58) Field of Classification Search
CPC ..... B65D 81/3813; B65D 81/3823; B65D 88/02; B65D 90/022; B65D 90/029; B65D 90/24; B65D 90/50; B65D 90/501; B65D 90/503; F17C 2203/011; F17C 2203/0619; F17C 2203/0621; F17C 2203/0624; F17C 2203/0626; F17C 2203/0631; F17C 2203/0634; F17C 2223/0161; F17C 2223/0033
USPC ..... 52/223.2–223.3, 246, 249–250, 52/264–265, 404.1, 405.1, 405.3; 220/560.03–560.04, 560.1, 560.12, 220/565, 592.01, 592.2, 592.26, 626–627
See application file for complete search history.

(56) References Cited

U.S. PATENT DOCUMENTS 3,092,933 A * 6/1963 Closner et al. ..... 220/560.05
3,558,000 A * 1/1971 McCann et al. ..... 220/560.06

(Continued)

FOREIGN PATENT DOCUMENTS

DE 27 20 572 A1 11/1978
DE 3025619 A1 2/1982

(Continued)

*Primary Examiner* — Mickey Yu
*Assistant Examiner* — Brijesh V. Patel
(74) *Attorney, Agent, or Firm* — Birch, Stewart, Kolasch & Birch, LLP

(57) ABSTRACT

A cryogenic liquid storage tank includes a base plate and side wall extending upwardly. The base plate and side wall include an outer leaf enveloping an inner leaf. The outer leaf part of the base plate includes a lower, outer leaf concrete bottom plate on a substrate. The bottom plate is continuous with an outer leaf reinforced concrete layer of the outer side wall. An inward surface of the bottom plate and concrete layer of the outer leaf are lined with a continuous outer leaf metallic membrane. A bottom insulation layer is arranged above the outer leaf metallic membrane on the bottom plate. The inner leaf includes an inner leaf concrete bottom layer on the bottom insulation portion. The inner leaf metal membrane is lined with an inner leaf inner concrete layer. The outer leaf hoop stress reinforced outer concrete wall supporting an insulated dome structure.

10 Claims, 12 Drawing Sheets

(52) U.S. Cl.

CPC ..... *F17C 2260/016* (2013.01); *F17C 2221/033* (2013.01); *F17C 2203/0341* (2013.01); *F17C 2260/011* (2013.01); *F17C 2221/011* (2013.01); *F17C 2209/22* (2013.01); *F17C 2221/014* (2013.01); *F17C 2203/0304* (2013.01); *F17C 2201/0109* (2013.01); *F17C 2209/232* (2013.01); *F17C 2203/0629* (2013.01); *F17C 2203/0678* (2013.01); *F17C 2203/0639* (2013.01); *F17C 2223/0161* (2013.01); *F17C 2201/032* (2013.01); *F17C 2209/221* (2013.01); *F17C 2201/0104* (2013.01); *F17C 2201/0119* (2013.01); *F17C 2270/0134* (2013.01); *F17C 2201/052* (2013.01); *F17C 2223/033* (2013.01); *F17C 2201/0128* (2013.01)

USPC ..... 220/560.12; 220/560.1; 220/560.04; 220/592.26; 220/626; 220/627; 52/405.3; 52/405.1; 52/404.1; 52/265; 52/264; 52/250

(56) References Cited

U.S. PATENT DOCUMENTS

| | | | | |
|---|---|---|---|---|
| 3,633,328 | A * | 1/1972 | Closner et al. | 52/223.2 |
| 3,655,086 | A | 4/1972 | Trenner | |
| 3,852,973 | A * | 12/1974 | Marothy | 220/560.05 |
| 3,919,855 | A | 11/1975 | Turner | |
| 3,948,406 | A * | 4/1976 | Papanicolaou et al. | 220/565 |
| 4,069,642 | A * | 1/1978 | Hendriks | 52/223.2 |
| 4,095,546 | A | 6/1978 | Kane | |
| 4,426,817 | A * | 1/1984 | Bomhard | 52/262 |
| 4,513,550 | A * | 4/1985 | Kotcharian | 52/745.01 |
| 4,584,802 | A * | 4/1986 | Casselman et al. | 52/169.7 |
| 5,231,811 | A | 8/1993 | Andrepont et al. | |
| 5,543,188 | A * | 8/1996 | Te'eni | 428/36.6 |
| 2005/0144864 | A1 * | 7/2005 | Skovholt et al. | 52/223.3 |
| 2007/0172616 | A1 * | 7/2007 | Ehsani et al. | 428/36.1 |
| 2007/0181586 | A1 * | 8/2007 | Van Ootmarsum et al. | 220/592.26 |
| 2008/0209918 | A1 * | 9/2008 | White | 62/50.1 |
| 2008/0302804 | A1 * | 12/2008 | Simmons et al. | 220/560.05 |
| 2010/0078439 | A1 | 4/2010 | Janssen et al. | |
| 2011/0168722 | A1 * | 7/2011 | Baudat et al. | 220/560.12 |

FOREIGN PATENT DOCUMENTS

| | | | |
|---|---|---|---|
| GB | 729166 | A | 5/1955 |
| GB | 2 058 320 | A | 4/1981 |
| WO | WO 98/58855 | A1 | 12/1998 |
| WO | WO 03/069087 | A1 | 8/2003 |
| WO | WO 2004/001280 | A1 | 12/2003 |
| WO | WO 2004/001281 | A1 | 12/2003 |
| WO | WO 2006/014101 | A1 | 2/2006 |
| WO | WO 2006/046872 | A1 | 5/2006 |
| WO | WO 2008/068303 | A1 | 6/2008 |

* cited by examiner

CRYOGENIC LIQUID STORAGE TANK

INTRODUCTION

The present invention relates to bulk liquid storage tanks, and is particularly concerned with tanks for storing cryogenic liquids such as liquid oxygen and nitrogen and liquid natural gas (LNG), which comprises mainly methane, ethane and propane.

BACKGROUND ART

Liquid natural gas is stored in large tanks at or close to ambient pressure and at cryogenic temperatures, the liquid in the tank being cooled as energy in the liquid is lost by some of the liquid boiling off as gas. Published PCT Application WO 2004/001280 describes such a tank. In order to reduce the loss of gas to a minimum, the walls, base and top of the storage tank are thermally insulated.

The base of a tank developed from the tank referred to above comprises a concrete footing, on which an outer metal plate is laid. A thermally insulating layer of foamed glass blocks is laid on the outer metal plate. A concrete base is then laid on the insulating layer, to form the bottom of an inner tank. A metal base is then built up from welded plates, to extend over the concrete base. In an embodiment of the invention, an outer edge of the metal base has a thickened region on which at least a part of the inner tank sidewall stands. The metal base of the inner tank is joined to a metal layer in the sidewall of the tank, to contain the liquid in the inner tank.

A cryogenic liquid tank conventionally comprises an inner tank having a sidewall including a metal layer joined to the metal base to contain the LNG, and an outer tank surrounding the inner tank and spaced from it.

The tank according to the invention comprising the bottom and the sidewall thus can be considered to be a cavity wall comprising an inner leaf forming the bottom and the sidewall of the inner tank, and an outer leaf forming the bottom and the sidewall of the outer tank. The space between the inner and outer leaves of the sidewall is filled with an insulating material such as perlite.

In order best to cope with the hydrostatic pressures exerted by the liquid on the inner leaf of the tank sidewall, and to facilitate fabrication of the tanks, LNG storage tanks conventionally have a circular shape in plan, and vertical walls forming a cylindrical shape. The top edge of the outer leaf of the sidewall of the tank is reinforced by a ring beam structure to take up the forces exerted by a steel and concrete dome structure placed over the top of the tank to rest on the outer leaf of the sidewall. The steel structure of the dome may be prefabricated as a single piece and lifted into place intact. Alternatively, and particularly when slip-forming is used to construct the tank sidewall, the steel structure of the dome may be prefabricated as a series of sectors, and assembled once the outer leaf of the sidewall of the tank has been raised to the desired height. The steel structure of the dome is not a significant weight and may simply rest on the outer leaf of the tank sidewall. The ring beam structure installed around the top of the wall is reinforced circumferentially to withstand the hoop stresses produced when the dome is finished with a concrete layer.

An insulating layer on top of the inner tank is usually arranged on a comparatively light lid structure which is suspended from the dome, to reduce heat influx into the surface of the liquid gas stored in the tank while being permeable to gas boiling off the liquid surface.

In the prior art, the inner leaf of a storage tank sidewall was fabricated from thick sheet metal in order to provide strength and liquid-tightness. Steel plates used for such purpose in such background art cryogenic tanks may be up to 38 mm thickness according to the inventors' knowledge. The thick sheet metal inner leaf was joined to the metal layer of the base by welding. However, the thick metal plates are expensive to produce and to shape and take time to join together, making this form of construction expensive.

In the prior art referred to above, the inner leaves of tank walls have been constructed by the use of a compact sandwich construction for the inner leaf, in which the inner leaf comprises a first erected slip-formed concrete inner layer surrounded by a thin metal layer, which in turn is surrounded by a subsequently slip-formed concrete outer layer. This sandwich construction enables the inner leaf to have a thinner metal layer than the "all-metal" inner leaf of the earlier tanks. Furthermore, the sandwich construction eliminates the disadvantage that when the liquid gas is placed in the tank, the cryogenic temperatures cause the liner to contract away from the outer concrete layer, stressing the attachments which fix the steel liner to the concrete.

At its lower edge, the thin metal layer is welded to a horizontal ring-shaped metal base plate forming the base of the inner leaf, the ring-shaped metal plate welded along its inner periphery to an outer periphery of the metal layer of the base to provide fluid-tightness.

The inner leaves of tank walls using this sandwich construction are usually made by a slip-casting process, in which a planar base structure is formed, a slip mould for an inner concrete structure is initially assembled on the base structure, and the inner concrete structure is slip formed to the desired height of the tank. Subsequently, the metal layer is arranged on the outer surface of the inner concrete structure, and then a slip form for the outer concrete structure of the inner leaf is arranged and slip-forming of this outer concrete structure of the inner leaf is carried out until the desired height of the inner leaf is reached. The metal layer is built up of lap-welded steel plates which may be erected as the inner concrete layer of the inner leaf is raised. The inner concrete layer, the metal layer, and the outer concrete layers of the inner leaf of the wall are thus formed sequentially according to the prior art.

In all of the previous techniques, however, the wall of the tank is a vertically-oriented cylinder of circular horizontal cross-section, with vertical side walls.

One limiting factor in the construction of such tanks is the size of the dome. A main limiting factor is the size of the dome and the generally horizontal forces induced on the top of the sidewall by the weight of the dome. Another limiting factor is the internal bending moment induced in a widely spanning dome.

Generally, there are two alternative ways of forming the dome on a cylindrical (vertical-wall) tank. The first is by forming the outer leaf of the tank sidewall, then constructing the steel structure of the dome within the bottom of the outer leaf, lifting the steel structure to its final position at the top of the outer leaf and attaching the steel structure there, and then covering the steel structure of the dome with a concrete layer to form the finished roof of the tank. Subsequently, the inner leaf of the tank sidewall is formed. Clearly, the inner leaf may only be formed after the roof has been lifted into place on top of the outer leaf.

Alternatively, the roof may be formed by slip-forming at least the outer leaf, and then hoisting the steel structure of the roof in sections into place on top of the outer leaf, and then forming the concrete layer to complete the roof. The steel sections of the dome may only be lifted into place when weather conditions are calm, and thus construction schedules are easily disrupted. These limiting factors in practice determine the diameter of the tank.

The present invention seeks to provide a structure for LNG storage tanks which allows an increased volume of LNG to be stored in a tank having the same height and base footprint or having the same roof span as a conventional cylindrical tank.

A second objective is to provide an LNG storage tank which allows having the same or even larger volume of LNG stored in the tank while having the same height and footprint as a conventional tank, but having a reduced roof span.

A further objective is to provide a base structure for a storage tank with improved mechanical strength and improved thermal insulation compared to prior art base structures. The base structure of the invention may be used in conjunction with sidewall structures whose inner leaves are of the sandwich type.

BRIEF SUMMARY OF THE INVENTION

According to a first aspect of the present invention, a cryogenic liquid storage tank is constructed by providing a double concrete tank comprising a so-called inner leaf forming an inner tank mainly formed in concrete, and a so-called outer leaf forming an outer tank also mainly formed in concrete. The outer leaf comprises a generally planar base and an outer leaf side wall erected around the base. The base is preferably circular. A roof is arranged on top of the cryogenic storage tank. The cryogenic tank preferably comprises insulation material arranged between the inner and outer leaves. In an advantageous embodiment, the inner leaf is of sandwich construction, comprising an inner concrete layer, a metal central layer, and an outer concrete layer. In a preferred embodiment the outer leaf comprises an outer concrete layer lined by a metal layer for preventing boiled-off gas from escaping from the cryogenic tank. The tank preferably has a circular outline, when seen in plan view or in horizontal cross-section.

More specifically, the cryogenic liquid storage tank according to the first aspect of the invention comprises the following features:

- a planar base plate (2,5) and a side wall (3) extending upwardly around the base plate (2,5),
- said base plate (2) and side wall (3) comprising an outer leaf (3*b*) generally enveloping an inner leaf (3*a*), both generally forming structurally continuous transitions from said base plate (2) to said side wall (3),
- said outer leaf (3*b*) part of said base plate (2) comprising a lower, outer leaf concrete bottom plate (5) on a substrate,
- said outer leaf concrete bottom plate (5) formed continuous with an outer leaf reinforced concrete layer (50) of said outer side wall (3*b*), said outer leaf concrete layer (50) being hoop stress reinforced,
- an inward surface of said outer leaf concrete bottom plate (5) and said outer leaf hoop stress reinforced concrete layer (50) of said outer leaf (3*b*) lined with a metallically continuous outer leaf metallic membrane (6, 51),
- a bottom insulation layer (7) arranged above said outer leaf metallic membrane (6) on said lower concrete bottom plate (5), said bottom insulation layer (7) formed generally continuous with a wall insulation (14*i*) filled in an annular cavity (14) between the inner face of said outer leaf (3*b*) and an outer face of said inner leaf (3*a*),
- said inner leaf (3*a*) comprising an inner leaf concrete bottom layer (8) on said horizontal insulation portion (7), said inner leaf concrete bottom layer (8) formed structurally continuous with a hoop stress reinforced inner leaf wall outer concrete layer (11), both lined with a metallically continuous inner leaf metal membrane (9, 12),
- said inner leaf metal membrane (9, 12) lined with an inner leaf inner concrete layer (10, 13),
- said outer leaf hoop stress reinforced outer concrete wall (50) supporting an insulated dome structure (4).

In this advantageous embodiment, the inner leaf is of sandwich construction, comprising an inner concrete layer, a metal central layer, and an outer concrete layer.

The tank preferably has a circular outline, when seen in plan view or in horizontal cross-section.

In an embodiment of the invention, the side wall may be straight in the vertical direction and is curved in the horizontal direction, such as a generally vertical cylinder. In another embodiment of the invention, the side wall has a convex curvature in both the vertical and horizontal planes. The base is preferably circular.

The side wall may be inclined outwardly of the tank at its lower part and inwardly at its upper part. Alternatively, the side wall may be vertical at its lower part and curve inwardly at its upper part.

The curvature of the side wall in the vertical plane may be part-circular, so that the internal volume of the tank approximates a part-sphere. In a yet further alternative, the curvature of the side wall in the vertical plane may be at least partially parabolic. The tank wall may, however, take any other suitable convex curved shape in the vertical plane.

The sidewall of the tank preferably terminates in a hoop stress reinforced part of the upper part of the wall. In an embodiment this hoop stress reinforced part is a ring beam structure integrated at the upper edge, and a dome may be placed over the top of the tank, supported on the hoop stress reinforced upper part. In a preferred embodiment, the outer leaf is inclined inwardly at its upper part and thus has an improved capacity to accept combined radial and vertical forces, the ring beam function may be integrated in the hoop stress reinforced upper part of the outer leaf.

The steel structure of the dome may be prefabricated in sections. The sections may each be a sector of the dome.

The outer leaf of the sidewall may be angled to the vertical at its upper edge by an angle different from the inclination of the outer edge of the dome, giving rise to a visible "edge" surrounding the tank at the junction of the sidewall and the dome.

According to a second aspect of the present invention, a base for a liquid storage tank is constructed by providing a concrete footing with an overlying metal layer forming part of an outer tank, a thermal insulating layer overlying the metal layer, and a sealing base layer of an inner tank on the insulating layer. The sealing base layer of the inner tank comprises an underlying concrete layer, a metal sealing layer, and an inner concrete layer. The sealing base layer is a sandwich construction, and a similarly layered sandwich construction may be used for the inner leaf of the sidewall. In such cases, the metal sealing layer of the base layer of the inner tank is fixed to the metal layer of the inner leaf of the sidewall by welding or by being constituted by continuous metal formed to fit at the transition from bottom to wall, to provide a fluid-tight structure to contain the LNG.

The base structure of the second aspect may also be used in conjunction with sidewall structures having an inner leaf composed of a simple metal layer, or of a metal-lined concrete layer.

In one embodiment, the base structure according to the second aspect may be used in conjunction with side walls which are convexly curved in the horizontal and vertical directions. In an other embodiment, the base structure may be used in conjunction with a sidewall of vertical cylindrical construction.

Advantages of the Invention

An advantage of the invention, by integrating the metal barrier in the sandwich structure comprising an inner and an outer concrete layer of the inner leaf, is the fact that the thickness of the metal barrier may be reduced compared to what is used in the prior art. The significantly reduced thickness of the metal barrier allows selecting a higher quality metal membrane, e.g. a highly ductile, stainless steel which may follow and adapt to thermal contraction when the tank is cooled during filling of LNG.

Another advantage of the invention is that a continuous transition is obtained between the base sandwich structure and the wall sandwich structure, from a structural point of view forms no structural weakness. This is an advantage from a seismic safety point of view. It is also an advantage from a construction operational point of view because reinforcement may be continued from the bottom concrete layer to the wall layer both for the outer leaf and for the inner leaf without undesired termination of the reinforcement.

Further, it is a significant advantage from a leakage prevention point of view due to the formation of a continuous metal membrane and its undisturbed position between the concrete layers in the transition between floor and wall. It is a general problem with large concrete cryogenic tanks constructed according to the background art that they may be leak tested before being cooled down to cryogenic temperatures. However, with the background art tanks one may have no guarantee for fluid tightness after cryogenic cooling. The present invention, which provides a continuous metal membrane within the concrete layers of the inner leaf, may be tested for fluid tightness before being cooled from ambient temperature, and will have no relative movements between the metal membrane encapsulated and the encapsulating concrete layers of the inner leaf.

An advantage is also found in an embodiment with the combination of a continuous transition combined with the convex embodiment having an outwardly inclined lower side wall, the reduced angle for such a floor to wall transition the structural stability, particularly horizontal force transfer both during thermal contraction or expansion, is further enhanced as compared to the vertical cylindrical wall structure.

An advantage of the convex embodiment of the invention is that the surface area of the tank according to the invention is significantly reduced compared to the surface area of a cylindrical tank of the same volume. A convex tank may have a larger diameter at the middle of the side wall than at the bottom, and it may also have a reduced top diameter compared both to the middle and bottom of the side wall. The surface area of the tank according to the invention, given the area defined by the relative diameter of the base and the shape and relative diameter of the roof, approaches the surface area of a sphere, which is the smallest possible surface area for a given volume. The result of approaching the smaller surface area of a corresponding sphere reduces the heat influx to the cryogenic tank and thus the boil-off, which is proportional to the heat influx.

Another advantage of that embodiment is that, from an economical point of view, one may obtain a larger stored volume for the same mass of construction material.

A third advantage of that embodiment the invention, given the convex shape of the sidewall, is a lowered centre-of-mass of the entire tank with contents. This will reduce the moment incurred by horizontal accelerations in case of earthquakes.

A fourth advantage of that embodiment is that the reinforced ring beam structure may partially or fully be replaced by the strength of the upper part of the outer leaf itself, due to the geometrical shape and consequential ability to take up horizontal components of the forces induced by the roof structure. The upper part of the outer leaf may be additionally reinforced and/or thickened if desired.

The need for hoop stress reinforcing the top of the outer wall decreases with decreasing diameter of the dome roof. Another advantage achieved by dispensing with or reducing the huge mass of the ring beam, which may be heavily reinforced by pre-stressing cables and in some instances, for very large tanks, have a height of 3 meters and a width of 2 meters, and a diameter of close to 100 meters, is reducing the mere cost and time for constructing the ring beam. This will further lower the centre of mass of the tank as structure. Another aspect of the same advantage, from a seismological point of view, is reducing the horizontal inertial shear forces induced throughout the tank by the mass of the dome and ring beam, and particularly the shear forces between the ring beam and the upper portions of the outer leaf.

A further advantage of the convex embodiment of the invention is, given a reduced diameter top and a high liquid level, the area of the liquid surface may be reduced, reducing the risk of severe sloshing during earthquakes. Further, the area of the required circular insulation ceiling is reduced, and thus the weight of the ceiling and its insulation layer, which may reduce the building costs for the dome.

Another advantage of the convex shaped embodiment of the invention is the possibility of significantly reducing the diameter of the dome, thus reducing the need for reinforcing the transition between the dome and the upper part of the outer leaf. This reduces the costs for building the dome and reduces the obstacles related to wind conditions as the size of the structural parts of the dome is reduced.

BRIEF DESCRIPTION OF THE DRAWINGS

Embodiments of the invention will now be described in detail, with reference to the accompanying drawings, in which.

DETAILED DESCRIPTION OF THE ILLUSTRATED EMBODIMENTS

Figure 1:
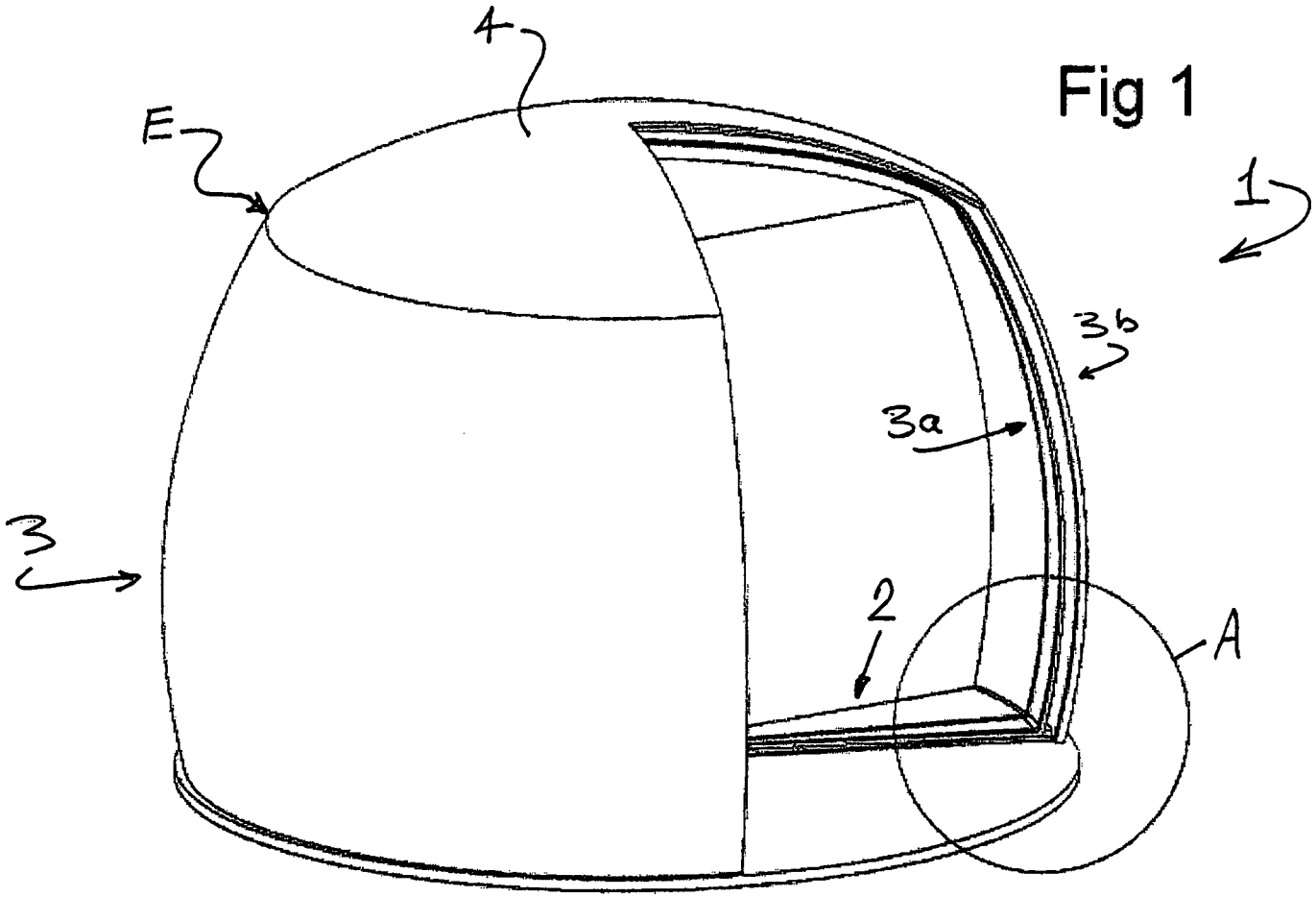
FIG. 1 is a schematic cutaway view of a storage tank according to an embodiment of the invention.
Figure 2:
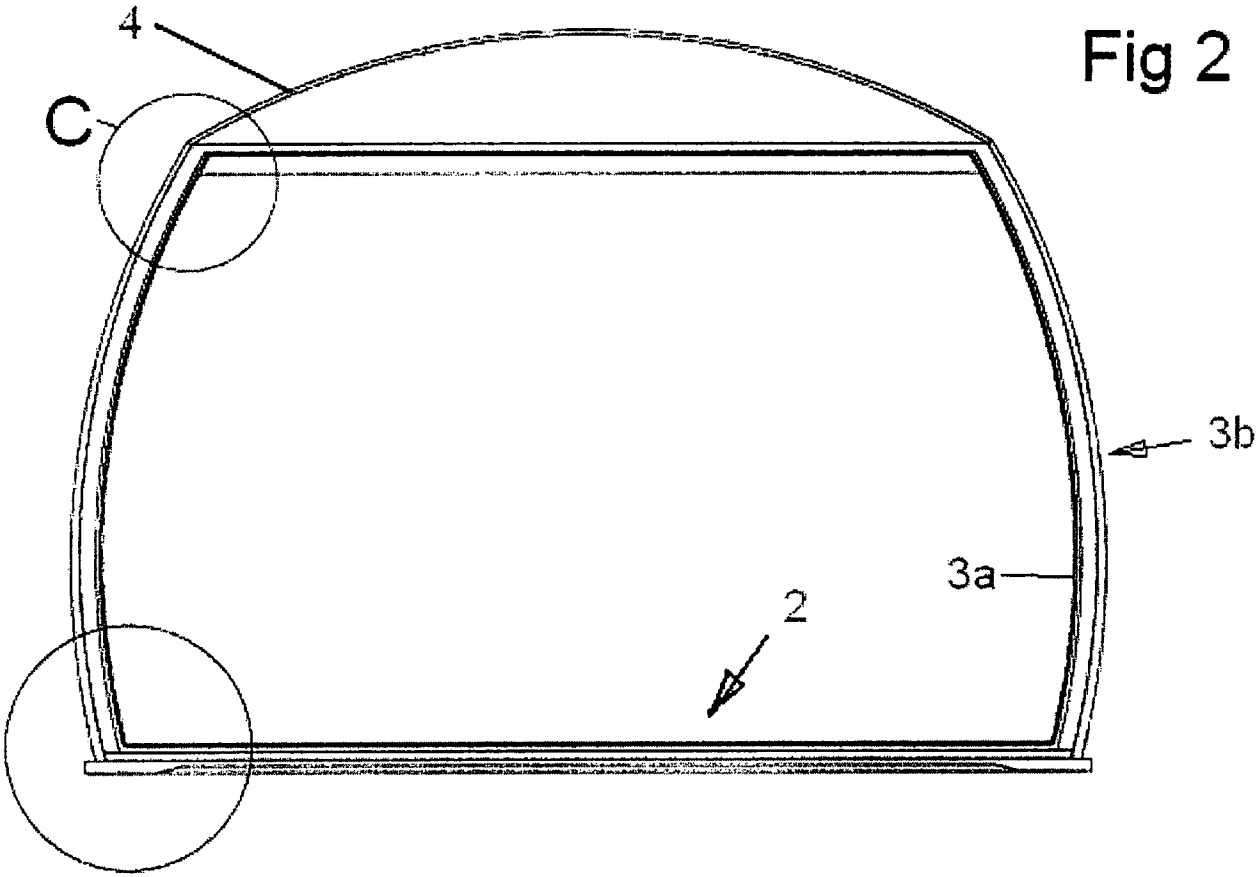
FIG. 2 is a diametral vertical section of the storage tank of FIG. 1.
Figure 3:
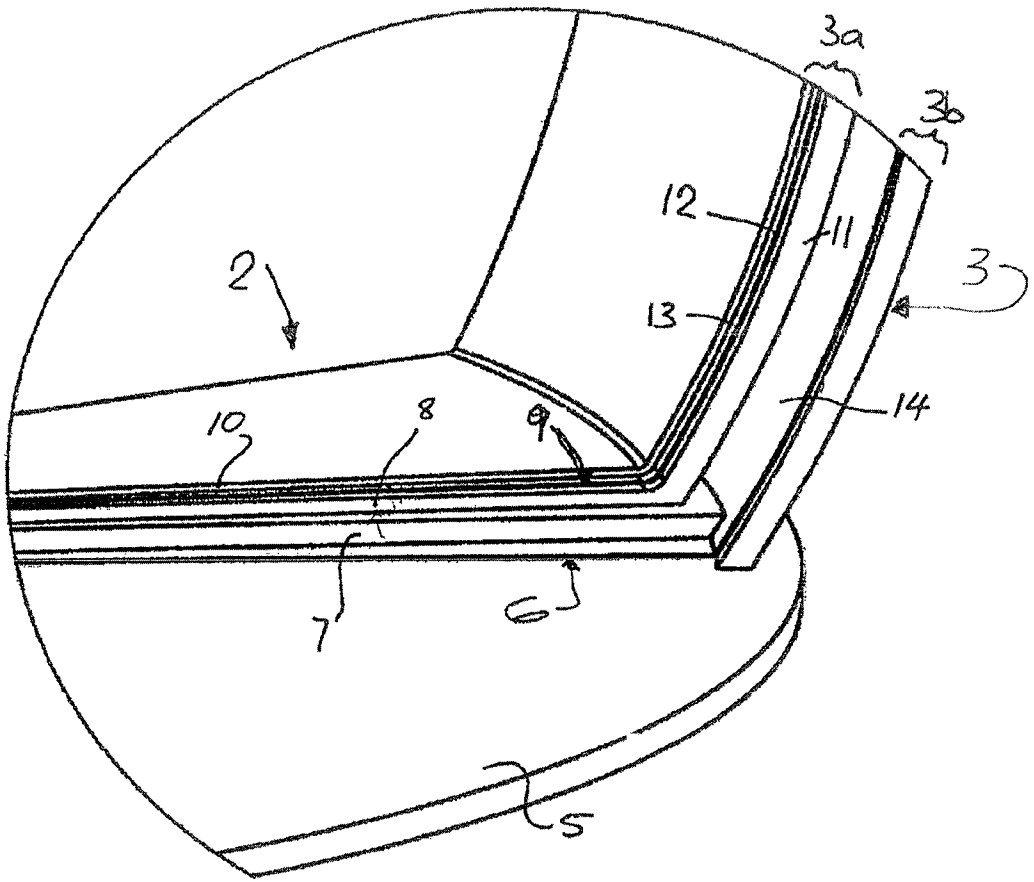
FIG. 3 is a detailed view, to a larger scale, of the area in circle A of FIG. 1, showing the bottom plate and the outer concrete wall of the outer leaf, and the bottom and wall sandwich-structure of the inner leaf.

Referring now to the drawings, FIGS. 1 to 3 illustrate an embodiment of a storage tank 1 according to the present invention. The storage tank 1 comprises an inner tank part and an outer tank part here called inner and outer leaves 3*a* and 3*b*. The tank wall 3 is formed on a circular base 2. A dome 4 closes the top of the tank 1.

As can be clearly seen from FIGS. 1 and 2, the sidewall 3 of the tank is generally circular in plan shape, but differs in an embodiment of the invention from the conventional tank in that the sidewall is not straight in vertical section, but it is curved so as to present a convex face to the outside of the tank. At the lower edge of the sidewall, the sidewall is inclined outwardly from the base. The sidewall 3 curves inwardly from the base to its upper edge, resulting in an outwardly convex shape to the tank.

In the illustrated embodiment, the base 2 comprises a firm footing, of for example concrete, in the form of a baseplate 5. The outer leaf part 3*b* of the sidewall 3 extends upwardly from the outer leaf part 3*b* baseplate 5 adjacent its outer edge. Overlying the baseplate 5 is an outer leaf metal liner 6, which forms a continuous metal layer over the baseplate 5 and extends upwardly to form the inner surface of the outer leaf part 3*b* of the sidewall 3. The metal liner 6 may extend only part-way up the outer leaf 3*b* of the sidewall 3, or may, in a preferred embodiment of the invention, extend up to the top edge of the outer leaf 3*b*.

A thermally insulating layer 7 of, for example, foamed glass blocks, is laid on the outer metal liner 6 where it overlies the baseplate 5.

On top of the insulating layer 7, a "sandwich" base is formed of the inner leaf by first forming an underlayer 8 of concrete, on which is laid a metal inner liner 9. The base is finished by a further concrete layer 10 overlying the inner liner 9. A significant advantage of this concrete layer 10 of the sandwich structure of the inner leaf bottom structure is that the metal liner 9 is thus protected by the concrete layer from being damaged by any dropped object such as tools, bolts, nuts or other items during the building period. Further, the concrete layer keeps the metal liner in place.

The inner leaf part 3*a* of the sidewall 3 is then formed as a "sandwich" structure, having outer and inner concrete layers 11 and 13 with a metal liner 12 between them. The outer concrete layer 11 of the inner leaf 3*a* is preferably formed as a continuous layer with the underlayer 8 of the base, while the metal liner 12 of the inner leaf 3*a* is formed continuous and thus sealed to the inner leaf liner 9 of the base. Inner concrete layer 13 of the inner leaf 3*a* is preferably formed as a continuous layer with the concrete layer 10 of the base. In this way, the double cryogenic tank forms a "bucket in a bucket"-structure which is both leak-proof, durable, simple to build, and structurally strong.

The inner and outer leaf parts 3*a* and 3*b* of the sidewall 3 may be formed by slip-casting. When forming the inner leaf, the outer concrete layer 11 may be raised simultaneously with the metal liner 12, and the inner concrete layer 13 may be formed as a final step to complete the inner leaf 3*a*. If a convex shape of the tank is desired, current slip-casting techniques allow the inner and outer leaves of the sidewall 3 to be formed at angles of up to 30° to the vertical. The sidewall 3 may thus lean outwardly of the base at its lower part, and curve in the vertical direction so that at the upper part of the sidewall the inner and outer leaves are inclined inwardly of the base. The inner and outer leaves are separate structures, and to provide the thermal insulation of the tank an insulating material 14*i*, such as Perlite in granular or powder form, may be used to fill the cavity 14 between the inner and outer wall portions of leaves 3*a* and 3*b*.

The curved shape of the sidewall may increase the amount of liquid which can be stored in the tank for a given base diameter and height of the sidewall, and reduces the ratio of sidewall surface area to volume within the tank. This reduction in the ratio of surface area to volume reduces the heat inflow into the tank, and thus reduces the amount of gas lost to boiling.

The top of the tank may be closed by a conventional dome structure 4. The dome 4 may be formed from a number of sector-shaped parts, which are lifted into place individually and fixed together to form a mould for forming the completed concrete dome structure, as is currently conventional.

A tank according to the invention may have a minimum diameter of about 20 m and may be built very large, with a maximum diameter about 200 m. The minimum height actual may be about 12 m, but a maximal height may be about 120 m wall height, and possibly 150 m height with a dome. Thus the volume of the tank according to the invention may be between about 5000 m3 and tens of hundreds of thousands cubic meters.

Figure 4:
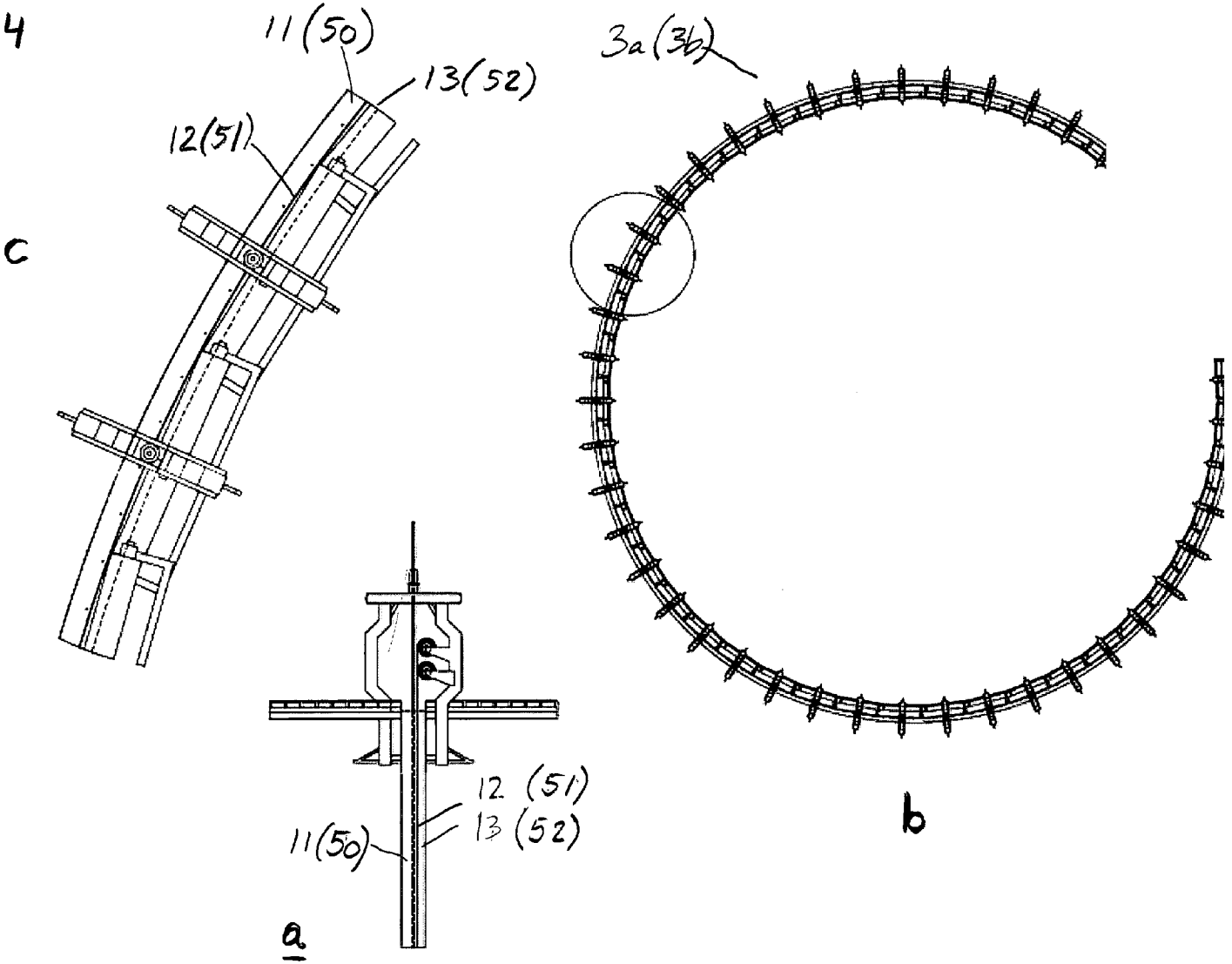
FIG. 4 is a view similar to FIG. 1 of a storage tank according to a second embodiment of the invention.

FIGS. 4*a*, 4*b* and 4*c* illustrate an embodiment of the invention in which rolls of metal membrane material may be arranged on yokes on the slip form for being fed down while the concrete walls are slip formed. FIG. 4*a* is a section view of a sandwich concrete wall is slip formed while a metal membrane is unrolled from the rolls on the yoke. FIG. 4*b* is a plan view of a slip form with yokes with rolls, arranged over a work deck, and FIG. 4*c* is an enlarged detail of the plan view showing yokes with yoke rods and membrane rolls and an outer slip form. An inner slip form is shown as a broken curve concentric with the outer slip form.

Figure 5:
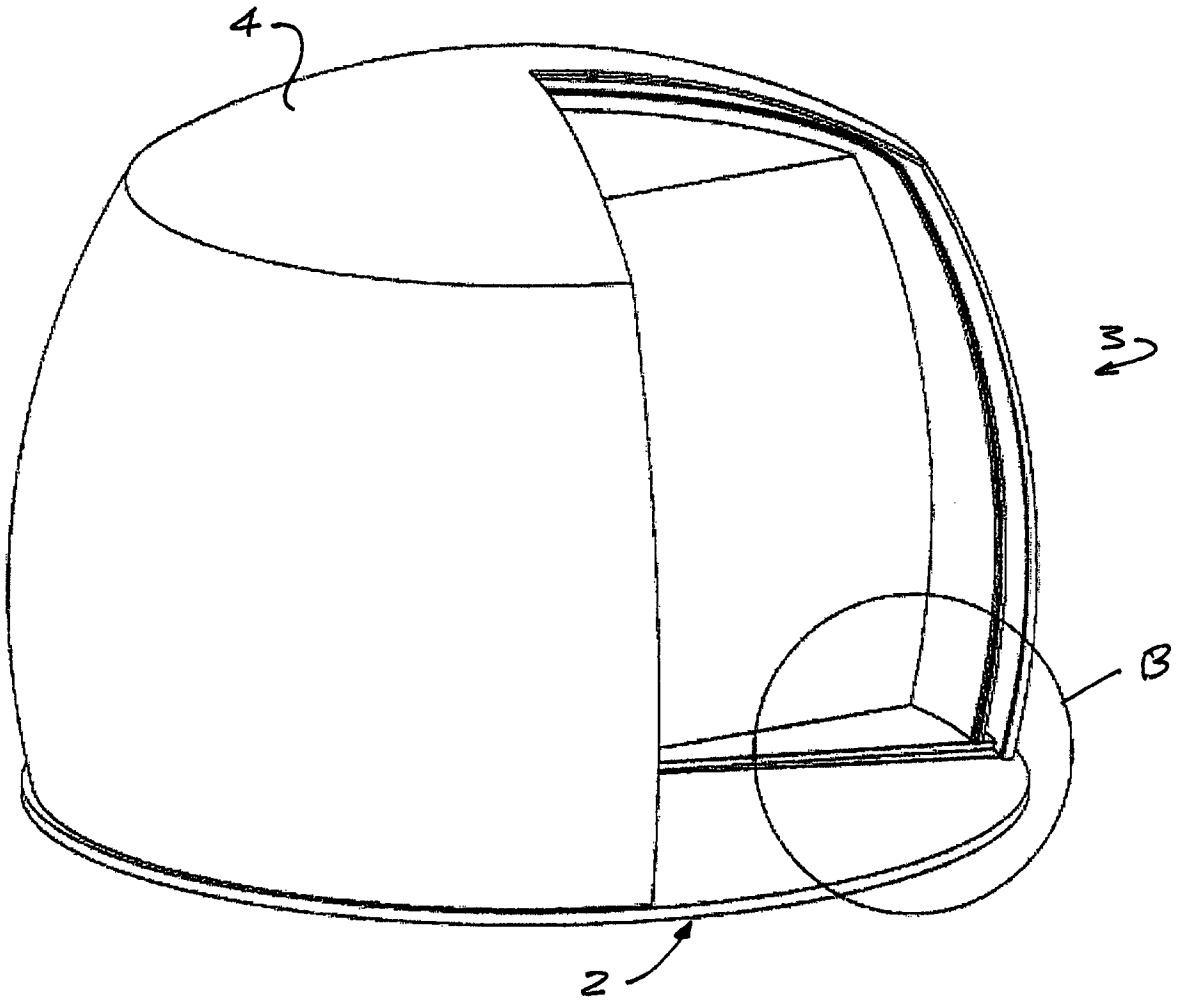
FIG. 5 is a view similar to FIG. 1 of a storage tank according to still another embodiment of the invention.
Figure 6:
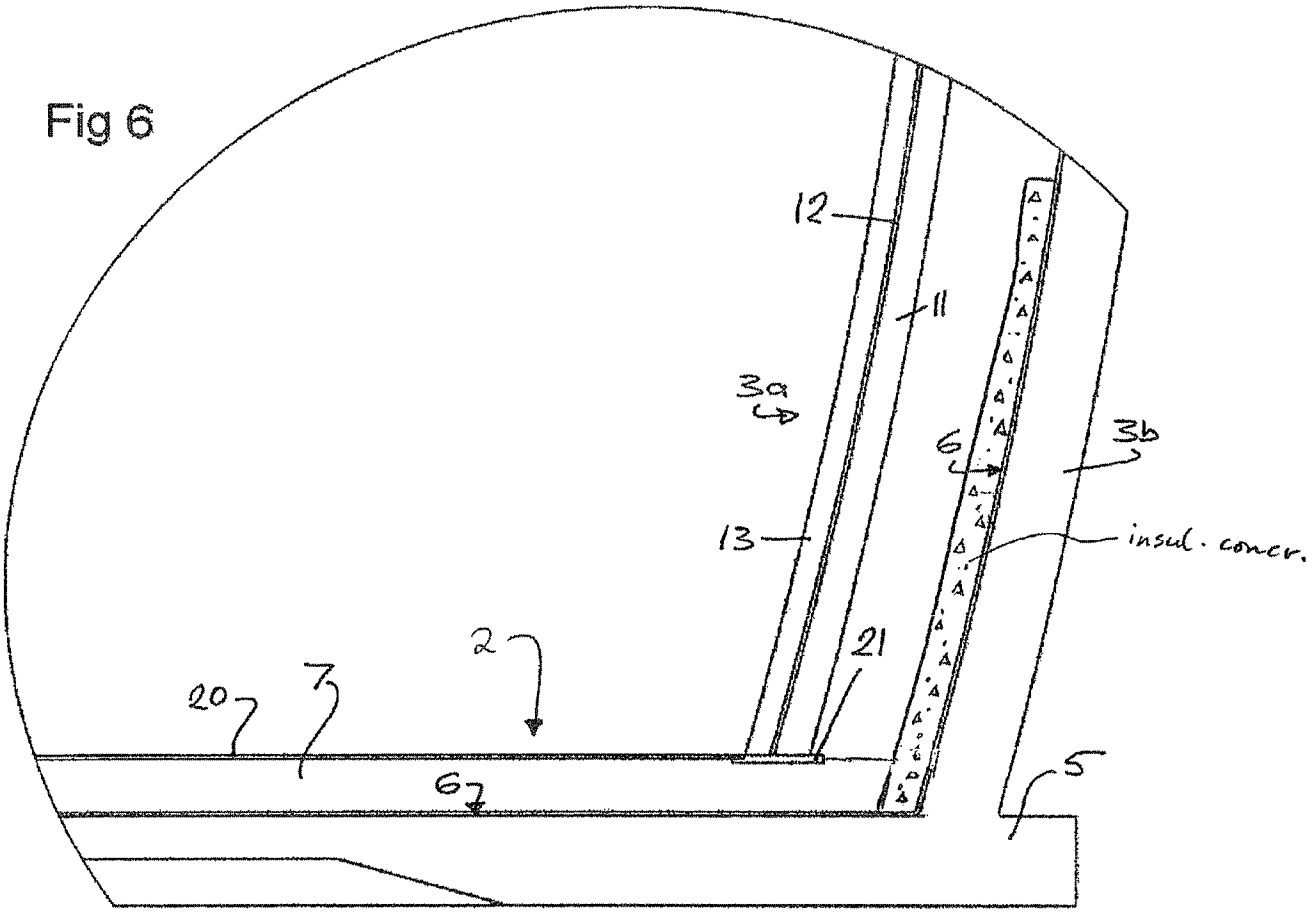
FIG. 6 is a detailed view, to a larger scale, of the area in circle B of FIG. 5.

FIG. 5 is a view similar to FIG. 1, showing an alternative structure for the base of the storage tank. An enlarged detail showing the base is seen in FIG. 6. In this embodiment, the base 2 of the tank is formed on a firm footing, of for example concrete, in the form of a baseplate 5. The outer leaf 3*b* of the sidewall 3 extends upwardly from the baseplate 5 adjacent its outer edge. Overlying the baseplate 5 is an outer metal liner 6, which forms a continuous metal layer over the baseplate 5 and extends upwardly to form the inner surface of the outer leaf 3*b* of the sidewall 3. The metal liner 6 may extend only part-way up the outer leaf 3*b* of the sidewall 3, or may preferably extend to the upper edge of the outer leaf 3*b*, as the entire outer leaf must be gas-proof in order to be able to contain boiled-off methane.

A thermally insulating layer 7 of, for example, foamed glass blocks, is laid on the outer metal liner 6 where it overlies the baseplate 5.

In this base structure, a metal baseplate 20 overlies the insulating layer 7. In an embodiment, the outer edge of the baseplate 20 being welded to an annular wall plate 21 also made of metal. In this embodiment, the inner leaf 3*a* of the sidewall 3 stands on the wall plate 21. In this embodiment, the inner leaf 3*a* is of a "sandwich" construction, and comprises an outer concrete layer 11, a metal liner 12 and an inner concrete layer 13, as described previously. The metal liner 12 may be welded directly to the metal base plate 20 on the bottom of the inner tank or indirectly by being welded to the wall plate 21 which is again welded the metal base plate 20, to provide a fluid-tight seal to contain the LNG within the tank. Again, the cavity between the inner and outer leaves 3*a* and 3*b* is filled with a thermal insulation (7) which is foamed glass, and (14*i*) thermal insulation material such as Perlite, which is a low-density powder or granular material. Preferably the bottom concrete plate and the outer concrete layer of the outer wall are continuous in the transition from base to wall.

An optional insulation-comprising layer 3*bi* as shown in FIG. 6 may be used in all embodiments of the invention. The layer 3*bi* may be arranged near the bottom corner of the tank outside or inside in connection with the outer leaf metal membrane, in order to prevent thermal cracking of the outer leaf outer concrete layer or bottom plate in case of leakage of said cryogenic fluid out of the inner leaf. The layer 3*bi* has advantages both in that it prevents cracking of the lower portions of the outer concrete wall of the outer leaf, and that it prevents thermal contraction of the metal membrane in the same area in case of a suddenly leaking inner leaf.

Figure 7:
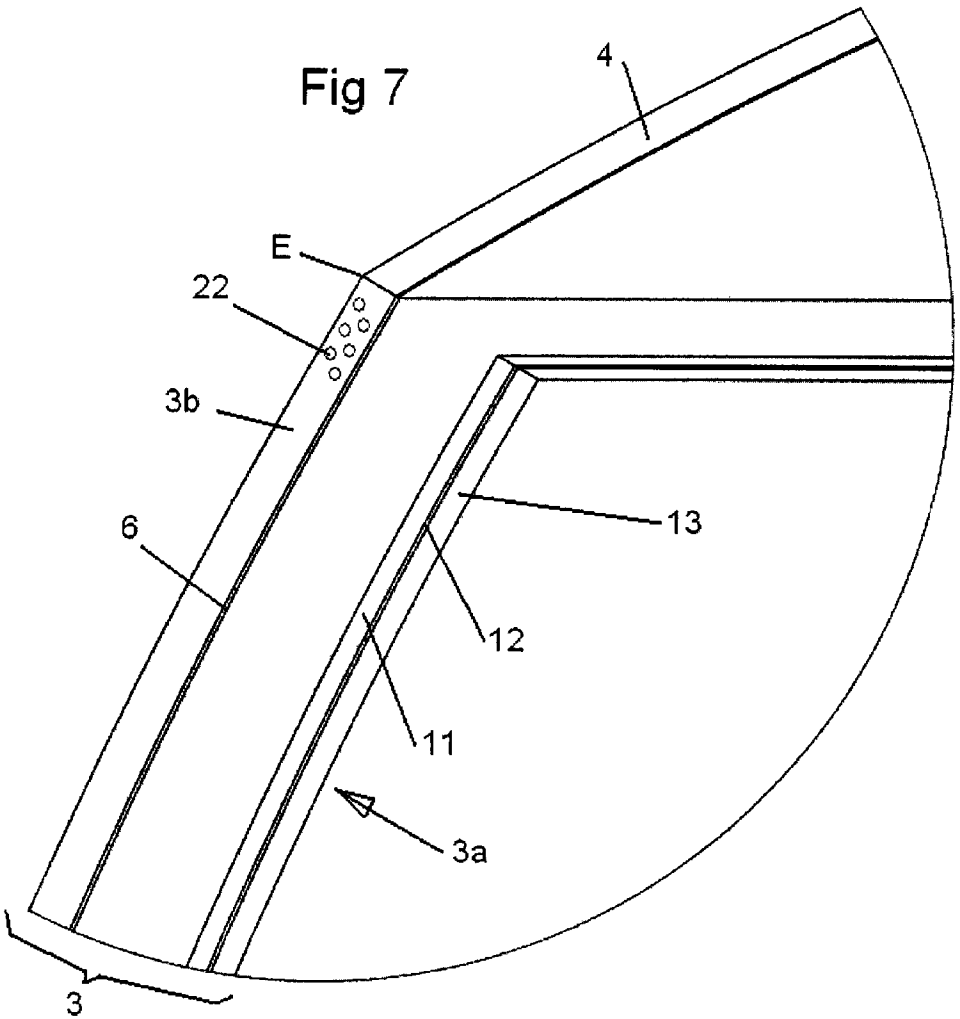
FIG. 7 is a detailed view, to a larger scale, of the area in circle C of FIG. 2 showing a part section and part elevation view of a the transition between the upper portion of the outer wall and the dome of a storage tank according to an embodiment of the invention.

FIG. 7 is a detailed view of the area in circle C of FIG. 2, showing the outer leaf 3*b* of the sidewall 3 with its metallic lining 6 extending to the upper edge E of the sidewall. The dome 4 is supported on the upper edge of the outer leaf 3*b* of the sidewall. The structural weight and the inward angling of the outer leaf 3*b* of the sidewall provides a lateral inward force component to counteract the outward pressure exerted by the dome structure, and thus the requirement for a separate reinforcing structure 22 at the upper edge of the outer leaf of the sidewall is significantly reduced.

In the structures seen in FIGS. 1, 2, 4, 5 and 7, the outer leaf of the sidewall is angled to the vertical at its upper edge by an angle different from that of the outer edge of the dome, giving rise to a visible edge "E" surrounding the tank at the junction of the sidewall and the dome.

Figure 8:
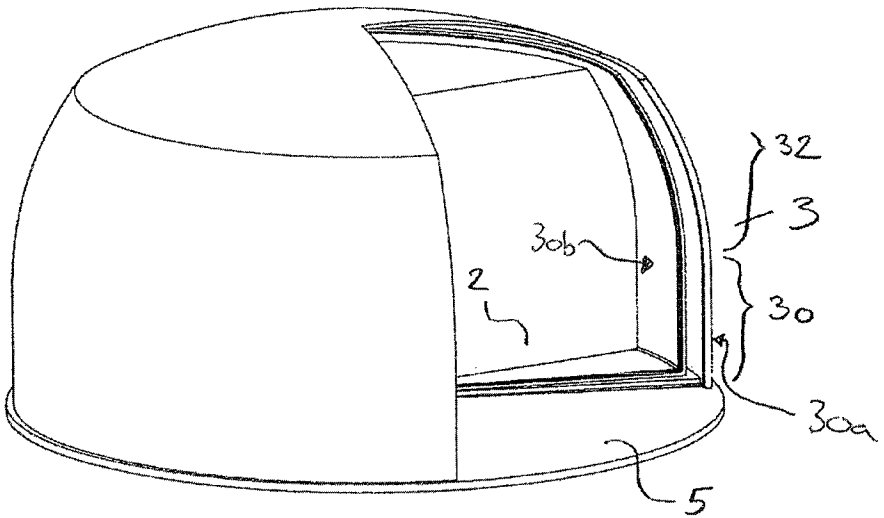
FIG. 8 is a view similar to FIG. 1 of a storage tank according to an embodiment of the invention, in which the sidewall has a straight vertical lower wall portion and an inwardly inclined convex upper portion. In the left portion of the drawing is shown to a larger scale an embodiment of the transition between the bottom plates and the lower portion of the walls in which the metal membranes of the inner leaf and outer leaf are continuous in their transitions between the bottom structures and the walls.
Figure 8:
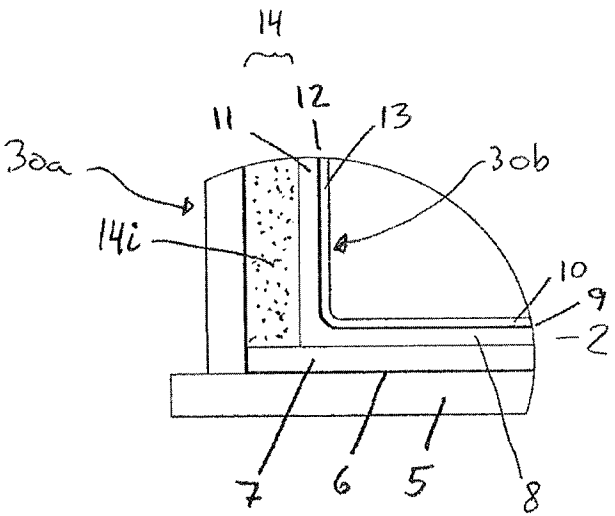

An embodiment of the invention is seen in FIG. 8. In the storage tank shown in FIG. 8, the sidewall 3 of the tank is of the same construction as that of FIGS. 1 to 3. However, in the embodiment of FIG. 8 the sidewall 3 of the tank is initially built up from the base as a vertical wall structure, then the sidewall is convexly curved round to be inwardly inclined at its upper edge. In other words, the sidewall 3 has a vertical lower section 30 with vertical inner and outer leaves 30*a* and 30*b*. The sidewall then inclines inwardly at an upper section 32, the section 32 being continuously curved in the vertical plane to give a convex wall structure. This structure provides a smooth convex external surface to the tank, and the vertical lower section 30 enables the slip-casting process to be started in a traditional manner. The top of the tank is closed by a dome structure 4 as previously described. Having a reduced diameter of the top of the side wall and the dome may allow to erect a higher side wall before mounting the dome.

Figure 9:
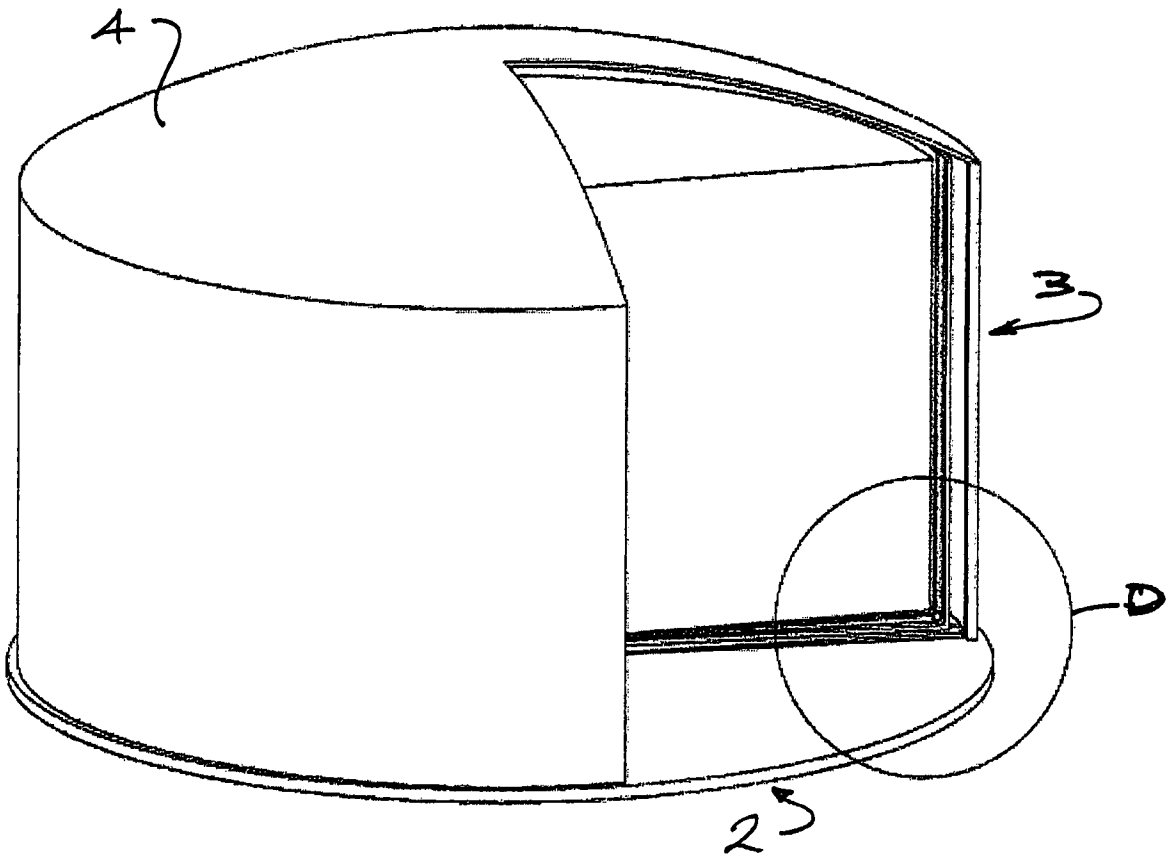
FIG. 9 is a view similar to FIG. 1 of a storage tank according to a vertical wall embodiment of the invention.
Figure 10:
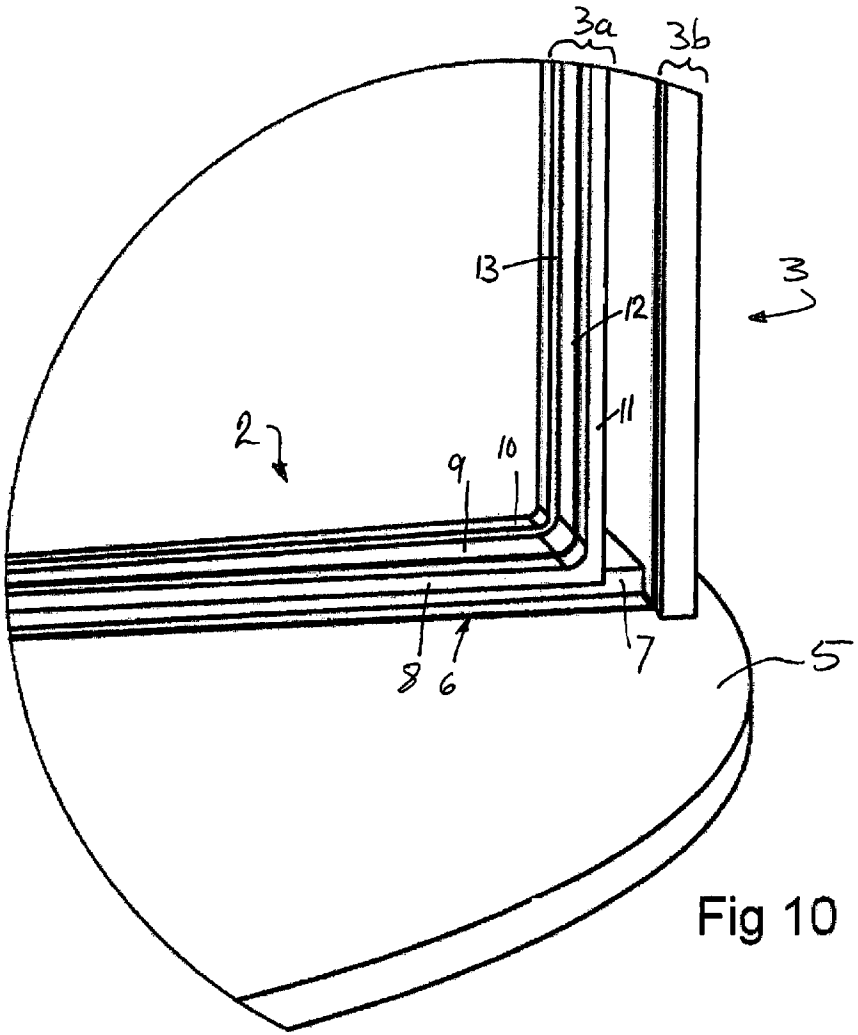
FIG. 10 is a detailed view, to a larger scale, of the area in circle C of FIG. 9. Here a continuous transition between the outer leaf bottom plate and outer, structural concrete wall is illustrated.

FIGS. 9 and 10 illustrate a storage tank according to the invention which is of more conventional appearance, having a vertical cylindrical side wall standing on a base of "sandwich" construction as described in relation to FIGS. 1 to 3. FIG. 10 is a view similar to FIG. 3 showing the elements of the base structure in circle D of FIG. 9. Corresponding reference numbers have been given to corresponding parts. In the embodiment shown in FIG. 10, the base 2 comprises a baseplate 5. The outer leaf 3*b* of the sidewall 3 extends upwardly from the baseplate 5 adjacent its outer edge. Overlying the baseplate 5 is an outer metal liner 6, which forms a continuous metal layer over the baseplate 5 and at its outer edge has an upstanding part which forms the inner surface of the outer leaf 3*b* of the sidewall 3. As before, a thermally insulating layer 7 is laid on the outer metal liner 6 where it overlies the baseplate 5. On top of the insulating layer 7, the "sandwich" base is formed by first laying an underlayer 8 of concrete, on which is laid a metal inner liner 9. The base is finished by a further concrete layer 10 overlying the inner liner 9.

The inner and outer leaves 3*b* and 3*a* of the sidewall extend vertically upwardly to form a circular cylindrical structure, and a conventional dome top structure is placed over the top of the tank to close the tank.

The LNG tank of FIGS. 9 and 10 thus has an external appearance with a vertical sidewall similar to a conventional tank, but the "sandwich" base structure allows the metal sealing layer 9 to be of reduced thickness, thus saving considerable expense in the construction of the tank. Furthermore, the concrete concrete layers 8 and 10 of the bottom part of the inner leaf are easily formed integrally with the concrete layers 11 and 13 of the inner leaf of the sidewall, providing increased structural strength at the lower edge of the sidewall and a simpler leak-proof design of the metal membrane 9, 12.

Figures 11A, 11B:
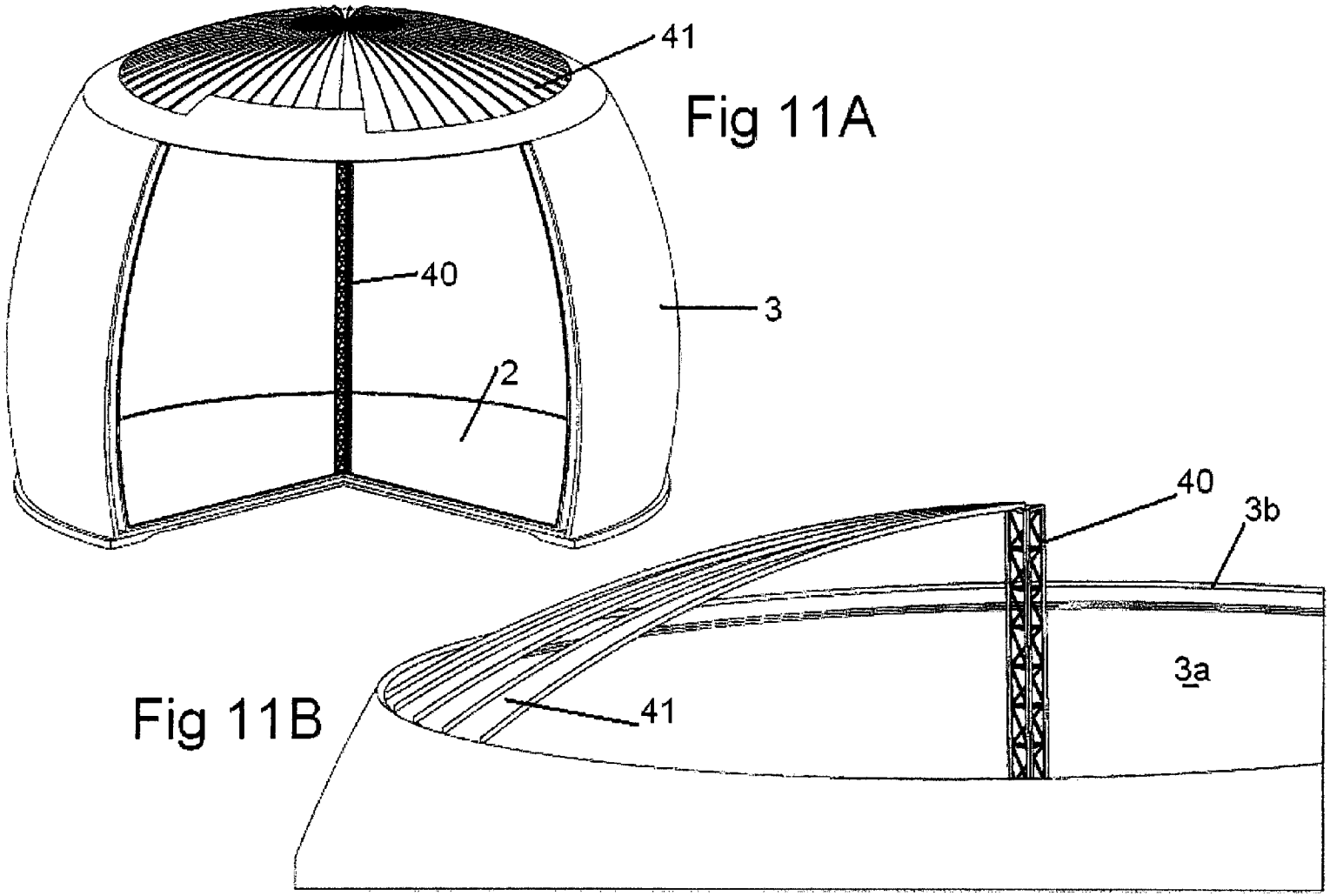
FIGS. 11A and 11B illustrate the placing of dome formers onto the sidewall, and forming of the dome.

FIGS. 11A and 11B show schematically the use of a temporary central tower 40 to assemble the steel structure sections for a dome 4 of a storage tank. When the outer leaf 3*b* of the—sidewall 3 of the storage tank has been formed, a central tower 40 is erected to extend vertically upwardly from the centre of the base of the tank, to a point above the upper edge of the sidewall 3. Sector-shaped parts 41 of the steel structure of the dome 4 may then be lifted into place, each part extending radially inwardly from the upper edge of the outer leaf 3*b* of the sidewall 3 to the top of the tower 40. Where all of the parts 41 have been lifted into place and fixed together at the centre, they form a self-supporting steel structure for the dome. The tower 40 may then be dismantled and removed, possibly through an opening in the steel structure of the dome 4. The dome is then completed by forming a concrete layer onto the steel structure to form a generally continuous concrete cover for the top of the tank.

Figure 12:
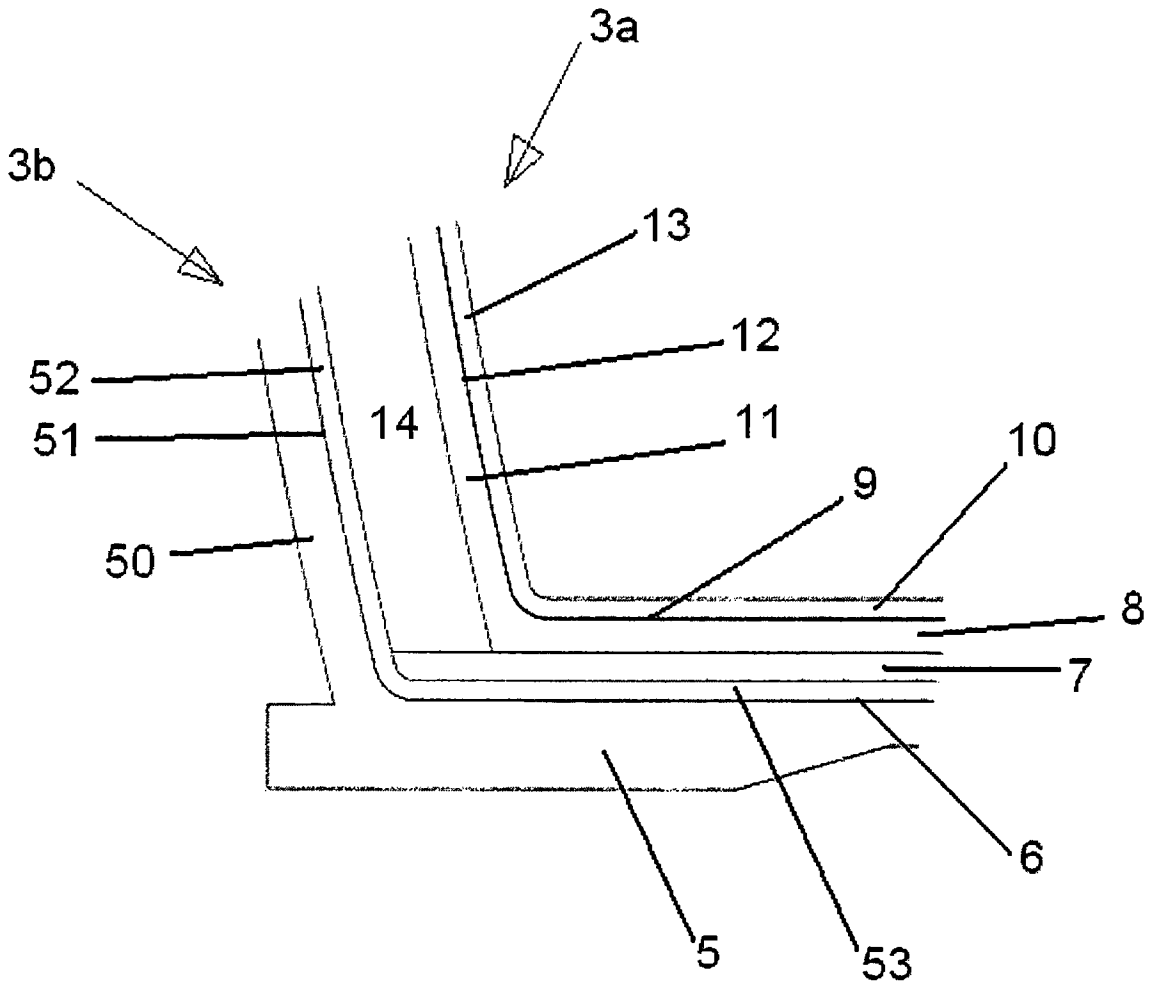
FIG. 12 is a sectional view of a preferred embodiment with a continuous structure for the outer leaf of the sidewall.

FIG. 12 is a detailed view showing an alternative construction for the joint between the base of the storage tank and the sidewall. The view is similar to that seen in FIG. 3, the difference being an additional layer of concrete in the construction of the outer leaf 3*b* of the sidewall, which is continued across the base of the storage tank.

In the embodiment shown in FIG. 3, the outer leaf of the sidewall comprises a metal inner layer and a concrete outer layer, with the metal inner layer of the sidewall being joined to a metal liner 6 extending across the baseplate 5 and directly overlying it. Like reference numerals are used for corresponding parts between FIGS. 3 and 12.

In the embodiment shown in FIG. 12, the outer leaf 3*b* is of sandwich construction, with an outer concrete layer 50, a metal sealing layer 51 and an inner concrete layer 52. The metal sealing layer 51 is joined to the metal liner 6 which extends across the baseplate 5. The inner concrete layer 52 of the outer leaf 3*b* of the sidewall 3 is contiguous with a concrete layer 53 extending between the baseplate 5 and the metal liner 6. The insulating layer 7 overlies the metal liner 6 and extends radially outwardly to the outer leaf of the sidewall. The cavity 14 between the inner and outer leaves of the sidewall is, as before, filled with insulation material. The metal sealing layer 51 may extend only part-way up the outer leaf of the sidewall for at least forming a secondary emergency fluid barrier in case of leak or rupture of the inner leaf, or may preferably extend to the upper edge of the outer leaf of the sidewall to make the outer leaf gas-proof. Although in FIG. 12 the inner and outer leaves of the sidewall are shown as extending upwardly at an oblique angle to the plane of the baseplate 5, the base structure seen in FIG. 12 may be used with the tank structure shown in FIG. 8, where the sidewall initially extends vertically from the base, and then curves in a convex outline as the sidewall progresses upward. Further, the base structure seen in FIG. 12 may also be used with the tank structure shown in FIG. 9, with vertical sidewalls.

The inner concrete layers of the inner leaf and/or the outer leaf may be fibre reinforced only, and may comprise porous material ("leca or perlite material or foam glass particles") to provide an insulation effect during ordinary operative state, and in case of fluid leakage to the outer tank).

The invention claimed is:

1. A cryogenic liquid storage tank comprising:

a planar base plate and a side wall extending upwardly around the base plate, said base plate and side wall comprising:

an inner leaf, the inner leaf comprising:

an inner leaf outer concrete layer, said inner leaf outer concrete layer being hoop stress reinforced;

an inner leaf inner concrete layer; and an inner leaf concrete bottom layer; and an outer leaf generally enveloping the inner leaf, said outer leaf comprising:

an outer leaf concrete layer, said outer leaf concrete layer being hoop stress reinforced; and a lower, outer leaf concrete bottom plate, wherein:

both the inner leaf and the outer leaf generally form structurally continuous transitions from said base plate to said side wall, said outer leaf concrete bottom plate is formed structurally continuous with the outer leaf concrete layer an inward surface of said outer leaf concrete bottom plate and said outer leaf concrete layer is lined with a metallically continuous outer leaf metallic membrane, a bottom insulation layer is arranged above said outer leaf metallic membrane on said lower, outer leaf concrete bottom plate, said bottom insulation layer being formed generally continuous with a wall insulation filled in an annular cavity between an inner face of said outer leaf and an outer face of said inner leaf, said inner leaf concrete bottom layer is formed on said bottom insulation layer, said inner leaf concrete bottom layer is formed structurally continuous with the inner leaf outer concrete layer, and the inner leaf concrete bottom layer and the inner leaf outer concrete layer are lined with a metallically continuous inner leaf metal membrane, said inner leaf metal membrane is sandwiched between the inner leaf outer concrete layer and the inner leaf inner concrete layer, and said outer leaf is configured to support an insulated dome structure.

2. The cryogenic liquid storage tank of claim 1, said outer leaf comprising a sandwich construction with an outer leaf inner concrete layer formed on said outer leaf metallic membrane which are further arranged on said outer leaf concrete bottom plate and said outer leaf concrete layer, said outer leaf inner concrete layer underlying said bottom insulation layer.

3. The cryogenic liquid storage tank of claim 1, said inner leaf inner concrete layer arranged for mechanically stabilizing said inner leaf metal membrane for preventing thermal contraction of said inner leaf metal membrane.

4. The cryogenic liquid storage tank of claim 1, said outer leaf inner concrete layer arranged for mechanically stabilizing said outer leaf metallic membrane preventing thermal contraction of said outer leaf metallic membrane in case of leakage of cryogenic fluid.

5. The cryogenic liquid storage tank of claim 1, wherein a curvature of the side wall in the vertical plane is convex in both the vertical and the horizontal planes.

6. The cryogenic liquid storage tank of claim 5, wherein the side wall is generally vertical at its lower part and curves inwardly at its upper part.

7. The cryogenic liquid storage tank of claim 1, said outer leaf terminating at an upper edge upon which said dome structure rests.

8. The cryogenic liquid storage tank of claim 1, wherein the bottom insulation layer includes no reinforcement.

9. The cryogenic liquid storage tank of claim 1, wherein the inner leaf metal membrane and the outer leaf metallic membrane are configured as fluid barriers to seal cryogenic liquid.

10. A method for constructing the cryogenic liquid storage tank comprising the steps of:

forming a planar base plate as a bottom part of an outer leaf, wherein the outer leaf comprises a lower, outer leaf concrete bottom plate, forming an outer leaf metallic membrane overlying said planar base plate, slip forming a hoop stress reinforced outer leaf concrete layer near a periphery of said planar base plate using a slip form, continuing forming said outer leaf metallic membrane extending upwardly along an inner face of said hoop stress reinforced outer leaf concrete layer, slip forming an outer leaf inner concrete layer by using a slip form, said outer leaf inner concrete layer formed along an inner surface of said outer leaf metallic membrane, while slip forming said hoop stress reinforced outer leaf concrete layer, thereby generally slip forming a side wall comprising an inner leaf and the outer leaf extending upwardly near the periphery of the planar base plate, forming outer leaf inner concrete layer, forming an insulation layer having a bottom insulation layer arranged upon said outer leaf inner concrete layer and outer leaf metallic membrane, on said outer leaf concrete bottom layer said insulation layer formed generally continuous with a wall insulation filled annular cavity between the inner face of said outer leaf and an outer face of said inner leaf, wherein:

said inner leaf comprises an inner leaf concrete bottom layer on said insulation layer, said inner leaf concrete bottom layer is formed structurally continuous with a hoop stress reinforced inner leaf outer concrete layer, said inner leaf concrete bottom layer and said hoop stress reinforced inner leaf wall outer concrete layer are lined with an inner leaf metal membrane, and said outer leaf is configured to support an insulated dome structure.

* * * * *